US007514396B2

(12) United States Patent
Motson et al.

(10) Patent No.: US 7,514,396 B2
(45) **Date of Patent: *Apr. 7, 2009**

(54) METHOD FOR CLEANING TEXTILES

(75) Inventors: Harold Russell Motson, Stockton on Tees (GB); Derek John Irvine, Stockton on Tees (GB); Eric Appelman, Dordrecht (NL)

(73) Assignee: Croda International PLC, East Yorkshire (GB)

( * ) Notice: Subject to any disclaimer, the term of this patent is extended or adjusted under 35 U.S.C. 154(b) by 285 days.

This patent is subject to a terminal disclaimer.

(21) Appl. No.: 10/518,921

(22) PCT Filed: Jun. 24, 2002

(86) PCT No.: PCT/GB02/02846

§ 371 (c)(1),
(2), (4) Date: Jul. 27, 2005

(87) PCT Pub. No.: WO04/001120

PCT Pub. Date: Dec. 31, 2003

(65) Prior Publication Data

US 2006/0178283 A1 Aug. 10, 2006

(51) Int. Cl.
*C11D 3/22* (2006.01)

(52) U.S. Cl. ..... 510/285; 510/470; 510/142; 510/158

(58) Field of Classification Search ..... 510/285, 510/130, 140; 134/10, 30
See application file for complete search history.

(56) References Cited

U.S. PATENT DOCUMENTS

| | | | | |
|---|---|---|---|---|
| 5,676,705 | A | 10/1997 | Jureller et al. | |
| 5,858,022 | A | 1/1999 | Romack et al. | |
| 6,148,645 | A | 11/2000 | DeYoung et al. | |
| 6,200,352 | B1 * | 3/2001 | Romack et al. | 8/142 |
| 6,258,766 | B1 | 7/2001 | Romack et al. | |
| 6,369,014 | B1 * | 4/2002 | Murphy et al. | 510/285 |
| 6,558,432 | B2 | 5/2003 | Schulte et al. | |
| 2002/0010965 | A1 | 1/2002 | Schulte et al. | |
| 2004/0031107 | A1 | 2/2004 | Pegelow et al. | |
| 2006/0107467 | A1 * | 5/2006 | Motson et al. | 8/142 |

FOREIGN PATENT DOCUMENTS

| | | |
|---|---|---|
| FR | 2171978 | 9/1973 |
| JP | 09-143497 | 6/1997 |
| JP | 09-176684 | 7/1997 |
| JP | 2001-514337 | 9/2001 |
| JP | 2002-543951 | 12/2002 |
| WO | WO94/01227 | 1/1994 |
| WO | WO99/10585 | 3/1999 |
| WO | WO 00/42249 | 7/2000 |
| WO | WO 00/70141 A | 11/2000 |
| WO | WO01/06053 | 1/2001 |
| WO | WO02/33039 | 4/2002 |

* cited by examiner

*Primary Examiner*—Mark Eashoo
*Assistant Examiner*—Mohammad R Asdjodi
(74) *Attorney, Agent, or Firm*—Jones Day

(57) ABSTRACT

Detergent or micelle free cleaning media based on detergent free and/or micelle free liquid $CO_2$ and including from 0.01 to 5% by weight of the formulation of a cleaning additive which is at least one multi-ester having a molecular weight of not more than 750 can be used in dry cleaning of textiles. Desirable cleaning additives are of the formula (1): $R^1(XR^2)_n$ where X, $R^1$, $R^2$, and n have defined meanings, particularly to be esters of multi-carboxylic acids and mono-hydroxy alcohols or esters of mono-carboxylic acids and multi-hydroxy alcohols.

21 Claims, No Drawings

METHOD FOR CLEANING TEXTILES

CROSS REFERENCE TO RELATED APPLICATION

This application is the National Phase application of International Application No. PCT/GB2002/002846, filed Jun. 24, 2002, which designates the United States and was published in English. This application, in its entirety, is incorporated herein by reference.

This invention relates to cleaning textile materials and products including clothes using liquid carbon dioxide ($CO_2$) and cleaning additives.

The dry cleaning of clothes using fluid carbon dioxide, either as liquid or supercritical fluid, is known from many patents. An early suggestion is in U.S. Pat. No. 4,012,194 (Maffei) which teaches simply using liquid carbon dioxide as a substitute for halocarbon solvents e.g. perchlorethylene (perc), used in conventional dry cleaning. Later patents develop approaches using detergent materials, including U.S. Pat. Nos. 5,676,705, 5,683,473, 5,683,977, 6,131,421, 6,148,644, and 6,299,652 assigned to Unilever and their equivalents, which relate to the use of defined detergents based on various classes of polymers and a series of cases, including U.S. Pat. Nos. 5,858,022, 6,200,352, 6,280,481, 6,297,206, 6,269,507 and US published application 200106053 A, assigned to MiCell and their equivalents. Also U.S. Pat. No. 5,279,615 assigned to Chlorox Co uses cleaning non-polar organic cleaning adjuncts, especially alkanes, in densified, particularly supercritical $CO_2$.

This invention is based on a liquid $CO_2$ dry cleaning medium including relatively polar multi-esters as cleaning additives which improve the cleaning performance of the liquid $CO_2$ and give improved handling characteristics as compared with the use of detergents available for use with liquid $CO_2$. The multi-esters are compounds having 2 or, more carboxylic acid ester groups, and molecular weights of not more than 750.

The invention accordingly provides a detergent free dry cleaning medium based on liquid $CO_2$ and including from 0.01 to 5% by weight of the cleaning medium of a cleaning additive which is at least one multi-ester having a molecular weight of not more than 750.

Alternatively the invention provides a micelle free dry cleaning medium based on liquid $CO_2$ and including from 0.01 to 5% by weight of the cleaning medium of a cleaning additive which is at least one multi-ester having a molecular weight of not more than 750.

The invention includes a method of dry cleaning which includes contacting textile material, particularly clothes, with a detergent free dry cleaning medium based on liquid $CO_2$ and including from 0.01 to 5% by weight of the cleaning medium of a cleaning additive which is at least one multi-ester having a molecular weight of not more than 750.

Further alternatively, the invention includes a method of dry cleaning which includes contacting textile material, particularly clothes, with a micelle free dry cleaning medium based on liquid $CO_2$ and including from 0.01 to 5% by weight of the cleaning medium of a cleaning additive which is at least one multi-ester having a molecular weight of not more than 750.

In the present invention in describing cleaning media as "detergent free" we mean that they do not include amphiphilic materials that aid soil removal from textiles. In describing cleaning media as "micelle free" we mean that the cleaning medium does not contain micelles of cleaning additives.

We have found that the presence of detergents including those which may form micelles in liquid $CO_2$ can reduce the effectiveness of the cleaning additives used in the invention.

The cleaning additive multi-esters used in this invention are desirably of the formula(I):

$$R^1(XR^2)_n \quad \text{(I)}$$

where

X is —C(O)O— or —OC(O)—; such that where X is —C(O)O—, $R^1$ is a direct bond or the residue of a $C_1$ to $C_{10}$ hydrocarbyl group from which n hydrogen atoms have been removed; and $R^2$ is a $C_1$ to $C_{10}$ hydrocarbyl group; and where X is —OC(O)—, $R^1$ is or the residue of a $C_2$ to $C_{10}$ hydrocarbyl group from which n hydrogen atoms have been removed; and $R^2$ is H or a $C_1$ to $C_{10}$ hydrocarbyl group; and n is from 2 to 5;

the compound having a molecular weight of not more than 750.

These cleaning additive multi-esters can be divided into two sub-classes respectively of the formulae (Ia) and (Ib) below. Compounds of the formula (Ia) are esters of a multi-carboxylic acid and a mono-hydroxy alcohol:

$$R^{1a}(XR^{2a})_n \quad \text{(Ia)}$$

where

X is —C(O)O—;

$R^{1a}$ is a direct bond or the residue of a $C_1$ to $C_{10}$ hydrocarbyl group from which n hydrogen atoms have been removed;

$R^{2a}$ is a $C_1$ to $C_{10}$ hydrocarbyl group; and the compound having a molecular weight of not more than 750.

Examples of compounds of the formula (Ia) include di-esters of dicarboxylic acids such as succinic, glutaric and adipic acids.

Compounds of the formula (Ib) are esters of a monocarboxylic acid and a multi-hydroxy alcohol:

$$R^{1b}(XR^{2b})_n \quad \text{(Ib)}$$

where

X is —OC(O)—;

$R^{1b}$ is or the residue of a $C_2$ to $C_{10}$ hydrocarbyl group from which n hydrogen atoms have been removed; and $R^{2b}$ is H or a $C_1$ to $C_{10}$ hydrocarbyl group; and the compound having a molecular weight of not more than 750.

Examples of compounds of the formula (Ib) include esters of multi-hydroxyl compounds such as triacetin (gycerol triacetate), ethylene glycol diacetate and pentaerythritol tetra-acetate.

The precise mode of action of the multi-ester cleaning additives is not clear. They do appear to boost the overall cleaning performance of liquid $CO_2$ but operating at levels that are significantly lower that would be expected to be effective if the effect were simply additive co-solvency. In addition the use of these additives gives improved handling of textiles cleaned using them as compared with no cleaning additives or commercially available detergents for use in liquid $CO_2$.

Within the formula (I) above, generally is desirable that the group X is —C(O)O— as these compounds seem to provide superior effects in cleaning. Among such compounds, the group $R^1$ is desirably —$(CH2)_m$— where m=2 to 6, particularly 2 to 4 and especially as in the mixed ester of succinic, glutaric and adipic acids; and the group $R^2$ is desirably methyl, ethyl or propyl, particularly methyl. Thus, the dimethyl esters of succinic, glutaric and adipic acids, particularly as mixtures are particularly desirable additives.

The molecular weight of the cleaning additive is not more than 750 and is desirably not more than 500. In practice the molecular weight for individual components e.g. of formula (I) can be as low as 118 (dimethyl oxalate) but will not usually be lower than 146 (dimethyl succinate and ethylene glycol diacetate). More usually on average the molecular weight will be at least 150, particularly from 150 to 300. The mixed dimethyl esters of succinic, glutaric and adipic acids can have molecular weights ranging from about 150 to 170 e.g. for an approximately 1:1:3 mixture the average molecular weight is about 165.

In order to maintain the desired high polarity, the ratio of oxygen to carbon atoms in the molecules of the cleaning additive is (on average) desirably from from 1:1 to 1:5 particularly from 1:1 to 1:3 and especially from 1:1 to 1:1.5. The mixed dimethyl esters mentioned above have an average ratio of ca 1:1.23.

The amount of cleaning additive multi-ester present in the cleaning medium is from 0.01 to 5%, usually from 0.05 to 2%, more usually from 0.1 to 1%, particularly from 0.1 to 0.5% and more particularly from 0.1 to 0.3% by weight of the cleaning medium. The use of lower amounts of cleaning additive will not generally give useful results and use of larger amounts does not appear to give additional benefits and may result in including so much additive in the system that additive residues are deposited onto the textiles being cleaned or left on the walls of the cleaning apparatus.

Other ingredients can be included in the dry cleaning formulation such as fragrances, optical brighteners, fabric conditioners such as softeners, and sizes e.g. starch, enzymes, bleaches, particularly peroxide bleaches e.g. organic and/or inorganic peroxides or hydrogen peroxide or a source of hydrogen peroxide.

The textiles to be cleaned will usually be garments and can be of woven or non-woven fabrics. The fibre making up the fabric can be or include a wide range of natural and synthetic fibres including polyamides particularly natural polyamides such as silk and wool and synthetic polyamides such as nylon, cellulosic fibres such as cotton, linen and rayon, synthetic polymers such as polyester, particularly polyethylene terephthalate or related copolymers, or acetate polymers. When fabrics including acetate polymers and possibly nylon polymers are cleaned it is best to avoid direct contact between the fabric and high concentrations of or neat multi-ester additives. When neat or at high concentration, the multi-ester additives may swell or dissolve such polymers leading to fabric damage. Thus it is desirable to pre-mix the multi-ester with $CO_2$ before permitting contact with such polymers. Premixing the multi-ester cleaning additive with $CO_2$ to give a concentration of less than about 10%, more usually less than 5%, and desirably not more than 2% by weight of the cleaning additive in the liquid $CO_2$ based cleaning medium before the additive comes into contact with the textile seems to avoid this potential problem.

The particular mode of operation will depend on the equipment used. Generally the cleaning will be carried out in a drum, which may have its axis vertical or horizontal. The textiles are introduced into the drum which is then sealed and filled with the cleaning medium including carbon dioxide typically to give a mixture of liquid and gaseous $CO_2$ in the drum. The textiles and liquid $CO_2$ based cleaning medium are then agitated to give thorough mixing and contact between the cleaning medium and textiles. The textiles will be contacted with the cleaning medium for a time adequate to clean the textiles to the desired extent. The cleaning medium is then separated from the textiles, typically by draining or venting it from the drum. Generally the textiles will be subject to one such cleaning cycle, but if desired the cleaning cycle may be repeated to obtain a higher degree of cleaning. Usually, the textiles are subject to at least one rinse cycle with liquid carbon dioxide usually not including cleaning additives, but which may include fabric softeners, optical bleaches etc if desired. The rinse liquid is similarly separated from the textiles, which can then recovered by de-pressurising the drum and opening it to removed the textiles.

Any suitable apparatus for dry cleaning with liquid carbon dioxide can be used. Typically such apparatus includes a drum in which the cleaning is carried out. The drum may have its axis horizontal or vertical. (Other angles of orientation will generally be less convenient in operation.) Providing agitation in a horizontal axis drum can simply be by rotation around its axis. Vertical axis drums will usually include an agitator which can be moved to agitate the drum contents. Other means of agitation include paddles or vanes in the drum or by jetting liquid $CO_2$ into the mixture of cleaning medium and textiles in the drum. Suitably vigorous agitation may give rise to cavitation in the cleaning medium and this may improve the cleaning, performance.

Typically the cleaning temperature will be from −10 to 25° C., more usually from 5 to 25° C., particularly from 10 to 20° C. The operating temperature will not usually be above about 25° C. to maintain the cleaning medium a reasonable margin from the critical point of $CO_2$, as supercritical $CO_2$ may extract textile dyes from fabrics. Operating at or near ambient temperature simplifies operation of the process, but using a lower temperature means that the $CO_2$ is more dense and a more effective cleaning agent. Temperatures in the range 10 to 17° C., particularly 12 to 15° C. generally provide a reasonable balance of properties and are thus advantageous.

During cleaning the cleaning medium must be kept at a pressure which maintains the $CO_2$ at least partially as a liquid. This will usually be the vapour pressure of the cleaning medium at the temperature of operation because, as is noted above, it is desirable for both liquid and gaseous $CO_2$ to be present. At the typical operating temperatures noted above, the corresponding pressures are approximately 2.7 to 6.4 MPa, more usually from 4 to 6.4 Mpa, particularly from 4.5 to 5.7 Mpa and balancing density and temperature 4.5 to 5.5 Mpa, particularly from 4.9 to 5.1 Mpa.

The invention is illustrated by the following Examples. All parts and percentages are by weight unless otherwise indicated.

Materials

CA1 mixed esters: dimethyl adipate (ca 60%), dimethyl glutamate (ca 20%), and dimethyl succinate (ca 20%)

CA1a additive CA1 plus a fragrance

CA2 mixed esters: dimethyl adipate (ca 90%) and dimethyl glutamate (ca 10%)

CA3 dimethyl adipate

CA4 triacetin

CD1 Kreussler—conventional formulated detergent

CD2 Fabritech 5565—conventional formulated detergent

CD3 Conventional detergent (composition not known)

Cleaning testing used standard "Krefeld" stained cloths. The codes for these cloths inlcude a number indicating the fabric type and a letter or letters indicating the soil as follows:

| Cloth Type | | Soil Type | | |
|---|---|---|---|---|
| 10 cotton | C | WFK soil*/lanolin mix | GM | used motor oil |
| 20 polycoton | D | sebum | TE | clay |
| 30 polyester (PET) | LS | Lipstick | PF | pigment/ vegetable fat |

*WFK soil - a mixed soil based on kaolinite and containing soot and iron oxide pigments Cleaning effectiveness—was assessed spectrometrically (using an X-Rite Spectrophotomeric Colour Measurement system) by comparison of commercially available standard soiled cloths before and after cleaning with the results given as % stain removal.

EXAMPLE 1

Various cleaning additives were tested for efficacy in removing stains from standard stained cloths using the experimental cleaning machine and method set out below.

Test Cleaning Procedure

An experimental cleaning machine is based on a pressure cylinder ca 50 cm long by 15 cm diameter (external); internal volume ca 6 l as the cleaning vessel. Connections are provided to enable the cylinder to be filled with carbon dioxide and emptied and for holding test cloths in the vessel.

Soiled fabric samples are held in place inside the pressure cylinder, the desired additive is introduced into the bottom of the cylinder using a syringe and the cylinder sealed. The cylinder is filled initially with gaseous carbon dioxide (to a minimum of 30 bar pressure) and then the desired quantity, usually from 1.5 to 2.0 kg (measured by logging the weight loss of the supply cylinder), of liquid carbon dioxide is introduced. The supply connections are removed and the test cylinder is rotated end over end for a predetermined time. The cylinder is then suspended with its axis vertical so that the 'dirty' liquid drains away from the washed fabric samples under gravity. The 'dirty' liquid $CO_2$ is vented to atmosphere. A rinse stage is normally carried out by repeating the filling process but without using any cleaning additive. The fabric samples are then removed from the machine removed and the stains examined using a computer controlled spectrophotomeric colour measurement system.

The cleaning conditions and the results obtained are set out in Table 1 below

TABLE 1

| | Wash Time | Rinse Time | Final Press. | Temp | Additive | | % Soil Removed | | | | |
|---|---|---|---|---|---|---|---|---|---|---|---|
| Ex No | (min) | (min) | (Bar) | (° C.) | type | (% w/w) | 30C | 30D | 10LS | 10PF | 10GM |
| 1.C.1 | 15 | 0 | 50 | 16 | none | — | 25 | 35 | 27 | 23 | 24 |
| 1.C.2 | 15 | 15 | 50/51 | 13/15 | CD1 | 0.2 | 28 | 39 | 29 | 29 | 26 |
| 1.1 | 15 | 15 | 50 | 15 | CA1 | 0.2 | 36 | 41 | 38 | 28 | 28 |
| 1.2 | 15 | 15 | 45 | 12 | CA1 | 0.2 | 33 | 32 | 30 | 23 | 24 |
| 1.3 | 15 | 15 | 48 | 14 | CA2 | 0.2 | 20 | 34 | 29 | 19 | 19 |
| 1.4 | 15 | 15 | — | — | CA3 | 0.2 | 33 | 42 | 30 | 25 | 27 |

EXAMPLE 2

Further tests were carried out in commercial scale liquid $CO_2$ dry cleaning equipment using standard Krefeld soiled cloths, pinned to blank textile sheets to provide more realistic behaviour in the cleaning machine. The results are set out in Table 2 below:

TABLE 2

| | Additive | | | | | | | | |
|---|---|---|---|---|---|---|---|---|---|
| Ex No | type | amount | 30C | 30D | 20MU | 10LS | 10PF | 10TE | 10GM |
| 2.1.C.1 | none | — | 42 | 55 | 31 | 36 | 38 | 18 | 26 |
| 2.1.C.2 | CD2 | 0.2 | 20 | 35 | 21 | 32 | 29 | 14 | 22 |
| 2.1 | CA1a | 0.2 | 48 | 67 | 39 | 39 | 47 | 24 | 28 |
| 2.2.C.1 | none | — | 38 | 64 | 32 | 38 | 41 | 18 | 26 |
| 2.2.C.2 | CD3 | 0.2 | 45 | 63 | 33 | 36 | 40 | 22 | 23 |
| 2.2 | CA1a | 0.2 | 45 | 69 | 32 | 39 | 45 | 23 | 24 |

The textiles cleaned using additive CA1a had a significantly improved feel as compared with cloths cleaned with liquid $CO_2$ alone or using the commercial detergent additives.

The invention claimed is:

1. A detergent free dry cleaning medium based on liquid $CO_2$ and including from 0.01 to 5% by weight of the cleaning medium of a cleaning additive which is at least one multi-ester having a molecular weight of not more than 750.

2. A dry cleaning formulation as claimed in claim 1 wherein the multi-ester includes at least one compound of the formula (I):

$$R^1(XR^2)_n \quad \text{(I)}$$

where

X is —C(O)O— or —OC(O)—; such that where X is —C(O)O—, $R^1$ is a direct bond or the residue of a $C_1$ to $C_{10}$ hydrocarbyl group from which n hydrogen atoms have been removed; and $R^2$ is a $C_1$ to $C_{10}$ hydrocarbyl group; and where X is —OC(O)—, $R^1$ is or the residue of $C_2$ to $C_{10}$ hydrocarbyl group from which n hydrogen atoms have been removed; and $R^2$ is H or a $C_1$ to $C_{10}$ hydrocarbyl group; and n is from 2 to 5;

the compound having a molecular weight of not more than 750.

3. A dry cleaning formulation as claimed in claim 2 wherein the multi-ester is of the formula (Ia):

$$R^{1a}(XR^{2a})_n \quad \text{(Ia)}$$

where

X is —C(O)O—;

$R^{1a}$ is a direct bond or the residue of a $C_1$ to $C_{10}$ hydrocarbyl group from which n hydrogen atoms have been removed; and $R^{2a}$ is a $C_1$ to $C_{10}$ hydrocarbyl group.

4. A dry cleaning formulation as claimed in claim 3 wherein the multi-ester is a dimethyl ester of adipic, glutaric or succinic acids or a mixture of such esters.

5. A dry cleaning formulation as claimed in claim 1 wherein the average molecular weight of the multi-ester(s) is from 150 to 300.

6. A dry cleaning formulation as claimed in claim 1 wherein the average ratio of oxygen atoms to carbon atoms in the multi-ester(s) is from 1:1 to 1:5.

7. A dry cleaning formulation as claimed in claim 6 wherein the average ratio of oxygen atoms to carbon atoms in the multi-ester(s) is from 1:1 to 1:1.5.

8. A dry cleaning formulation as claimed in claim 1 wherein the amount of cleaning additive multi-ester present in the cleaning medium is from 0.1 to 0.5% by weight of the cleaning medium.

9. A dry cleaning formulation as claimed in claim 1 which additionally includes at least one fragrance, optical brightener, fabric conditioner, enzyme and/or bleach.

10. A method of dry cleaning which includes contacting textile material with a detergent free dry cleaning medium based on liquid $CO_2$ and including from 0.01 to 5% by weight of the cleaning medium of a cleaning additive which is at least one multi-ester having a molecular weight of not more than 750.

11. A method as claimed in claim 10 wherein the multi-ester includes at least one compound of the formula (I):

$$R^1(XR^2)_n \quad \text{(I)}$$

where

X is —C(O)O— or —OC(O)—; such that where X is —C(O)O—,

R1 is a direct bond or the residue of a C1 to C10 hydrocarbyl group from which n hydrogen atoms have been removed; and R2 is a C1 to C10 hydrocarbyl group; and where X is —OC(O)—, R1 is or the residue of C2 to C10 hydrocarbyl group from which n hydrogen atoms have been removed; and R2 is H or a C1 to C10 hydrocarbyl group; and n is from 2 to 5;

the compound having a molecular weight of not more than 750.

12. A method as claimed in claim 11 wherein the multi-ester is of the formula (Ia):

$$R^{1a}(XR^{2a})_n \quad \text{(Ia)}$$

where

X is —C(O)O—;

$R^{1a}$ is a direct bond or a $C_1$ to $C_{10}$ hydrocarbyl group from which n hydrogen atoms have been removed; and $R^{2a}$ is a $C_1$ to $C_{10}$ hydrocarbyl group.

13. A method as claimed in claim 12 wherein the multi-ester is a dimethyl ester of adipic, glutaric or succinic acids or a mixture of such esters.

14. A method as claimed in claim 10 wherein the average molecular weight of the multi-ester(s) is from 150 to 300.

15. A method as claimed in claim 10 wherein the average ratio of oxygen atoms to carbon atoms in the multi-ester(s) is from 1:1 to 1:1.5.

16. A method as claimed in claim 10 wherein the amount of cleaning additive multi-ester present in the cleaning medium is from 0.1 to 0.5% by weight of the cleaning medium.

17. A method as claimed in claim 10 which additionally includes at least one fragrance, optical brightener, fabric conditioner, enzyme and/or bleach.

18. A method as claimed in claim 10 wherein the multi-ester is pre-mixed with liquid $CO_2$ before contacting the textiles.

19. A method as claimed in claim 10 wherein the cleaning process is carried out at a temperature of from −5 to 25° C.

20. A method as claimed in claim 19 wherein the temperature is from 5 to 20° C.

21. A method as claimed in claim 20 wherein the temperature is from 12 to 15° C.

* * * * *